United States Patent [19]

Culpepper

[11] 4,062,270

[45] Dec. 13, 1977

[54] PANEL INTERLOCKING MECHANISM FOR WRAPPER TYPE CARTONS

[75] Inventor: Will Lester Culpepper, Tucker, Ga.

[73] Assignee: The Mead Corporation, Dayton, Ohio

[21] Appl. No.: 759,540

[22] Filed: Jan. 14, 1977

[51] Int. Cl.[2] ..... B31B 1/60

[52] U.S. Cl. ..... 93/1.1; 229/40

[58] Field of Search ..... 93/1.1, 37 SP; 53/48; 229/40

[56] References Cited

U.S. PATENT DOCUMENTS

| | | | |
|---|---|---|---|
| 3,032,945 | 5/1962 | Currie, Jr. et al. | 53/48 |
| 3,186,136 | 6/1965 | Ganz | 53/48 X |
| 3,430,413 | 3/1969 | Wood | 53/48 |
| 3,543,473 | 12/1970 | Cato | 53/48 |
| 3,548,566 | 12/1970 | Sherman | 53/48 |

*Primary Examiner*—James F. Coan

*Attorney, Agent, or Firm*—Walter M. Rodgers; Walter A. Rodgers

[57] ABSTRACT

A locking tab formed in one panel and having a securing aperture at its base is driven through a locking aperture defined by a retaining tab formed in another face contacting panel so as to interlock the panels by panel interlocking mechanism including a rotatable locking element having radially disposed locking fingers thereon which are especially configured so that the end portion of each locking finger is substantially larger in cross sectional area than the securing aperture formed in the associated locking tab and with a clearance groove formed along one side of each locking finger for receiving the securing tab during a locking operation.

8 Claims, 8 Drawing Figures

PANEL INTERLOCKING MECHANISM FOR WRAPPER TYPE CARTONS

U.S. pat. No. 3,430,413 issued Mar. 4, 1969 and assigned to the assignee of this invention, discloses and claims a locking mechanism of the type to which this invention pertains and is widely used to interlock a pair of panels in face contacting relation by driving a conventional locking tab formed in one panel through an aperture defined by a retaining tab formed in the other panel.

Conventional locking tabs and their associated locking apertures and retaining tabs are substantially improved by the arrangement disclosed and claimed in U.S. patent application Ser. No. 759,057 filed Jan. 13, 1977 assigned to the assignee of this invention. Interlocking means according to application Ser. No. 759,057 is substantially strengthened and locking security enchanced because of a securing tab arranged to project from an edge of the locking aperture formed in one panel and which is received within a securing aperture at the base of a locking tab formed in another panel during a locking operation.

The panel interlocking mechanism formed according to this invention is especially adapted for use in conjunction with the panel interlocking means disclosed and claimed in U.S. Application Ser. No. 759,057 and comprises a movable locking finger having an end portion for engaging the locking tab and operable to drive the locking tab through the associated locking aperture and simultaneously to cause the securing aperture formed in the locking tab to receive the securing tab projecting from an edge of the locking aperture, the end of the locking finger which engages the locking tab being substantially larger in cross sectional area than the securing aperture formed in the locking tab and the locking finger having a clearance groove formed along a side thereof for receiving the securing tab during locking movement of the locking finger.

For a better understanding of the invention, reference may be had to the following detailed description taken in conjunction with the accompanying drawings in which FIG. 1 is a side view of a high speed packaging machine to which this invention is applicable;

FIGS. 6 and 7 are enlarged views which depict locking elements formed according to the invention; and in which

Figure 1:
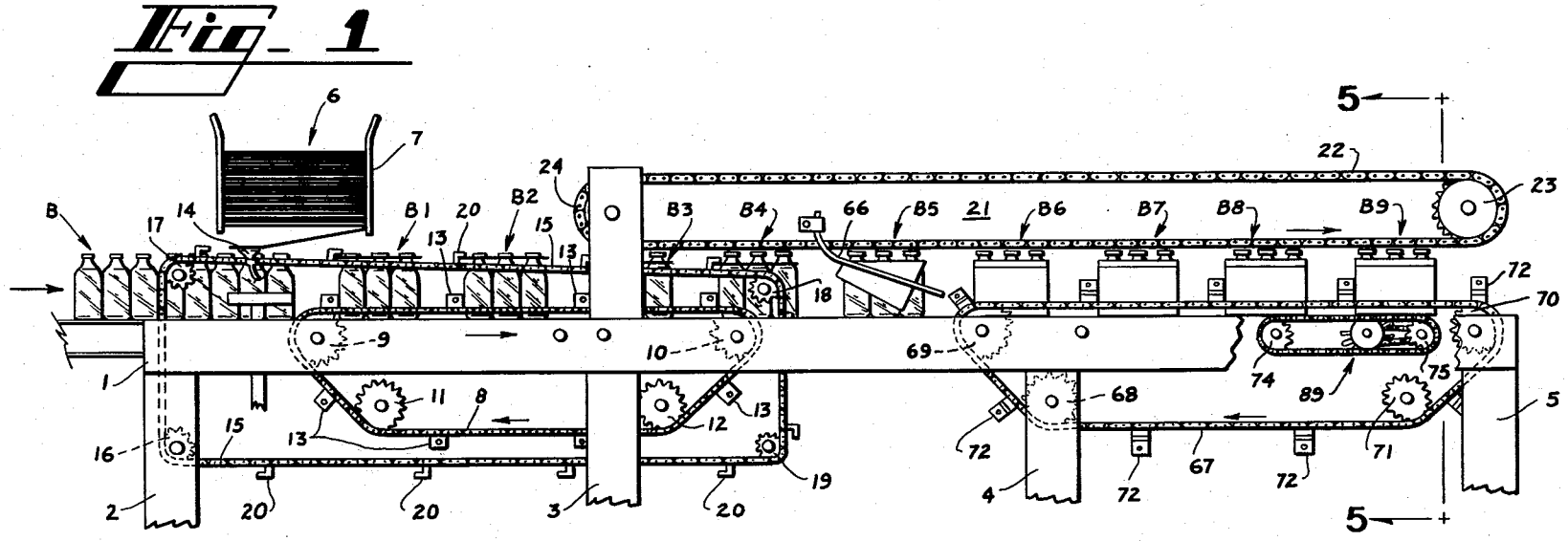

With reference to FIG. 1, the numeral 1 designates a transverse frame structure supported on vertical pedestals designated by the numerals 2, 3, 4 and 5. It will be understood that the pedestals 2–5 are mounted at their lower ends on a suitable base structure. A plurality of carrier blanks of the type shown in FIG. 2 and generally designated by the numeral 6 are disposed above the machine in a suitable hopper structure designated by the numeral 7. Primary packages such as the bottles designated by the letter B in FIG. 1 are introduced on a continuous conveyor or otherwise to the left hand end of the machine and proceed toward the right to the formation of a completed package such as is depicted in FIG. 3. During movement through the machine the primary packages B are arranged in a series of groups designated in FIG. 1 at B1, B2, B3, B4, B5, B6, B7, B8 and B9.

For the purpose of moving the bottle groups such as B1–B9 from left to right, an endless conveyor 8 is mounted in known manner on rotatable elements 9, 10, 11 and 12 which are supported by suitable shafts affixed to the frame of the machine in known manner. Secured to the conveyor 8 is a series of plungers or flight bars designated by the numeral 13. As is apparent from FIG. 1 the plungers engage a package group and impart movement thereto toward the right, it being apparent that the conveyor 8 and the rotatable elements on which the conveyor is mounted and which are designated by numerals 9–12 all rotate in a clockwise direction.

In order to withdraw the lowermost one of the blanks from the hopper 7, a suitable reciprocable suction plunger 14 is arranged to engage and draw downwardly such a blank so as to disposed the blank atop the immediately adjacent article group.

Once the lowermost blank 6 is withdrawn from the hopper 7, it must be moved in synchronism with one of the article groups such as B1. To this end, an endless conveyor 15 is suitably mounted in known manner on rotatable elements 16, 17, 18 and 19 and moves in a clockwise direction. The blanks 6 are engaged along their trailing edges by suitable hooks mounted on conveyor 15 and designated by the numeral 20. Thus, as the article groups such as B1, B2, etc., move toward the right, an associated blank 6 is moved atop each group by the action of conveyor 15 and its associated hooks 20 in a manner well known in the art.

Once the particular wrapper 6 is properly oriented with respect to its associated article group such for example as B3, suitable hold down mechanism serves to maintain the wrapper securely atop its associated group. Such mechanism is designated in FIG. 1 by the numeral 21 and simply comprises an endless conveyor 22 mounted on rotatable elements 23 and 24 which are mounted on shafts journaled in suitable bearings, the shaft for rotatable element 24 being journaled on frame element 3 while the shaft for rotatable element 23 is appropriately journaled on the boom 21.

Figure 2:
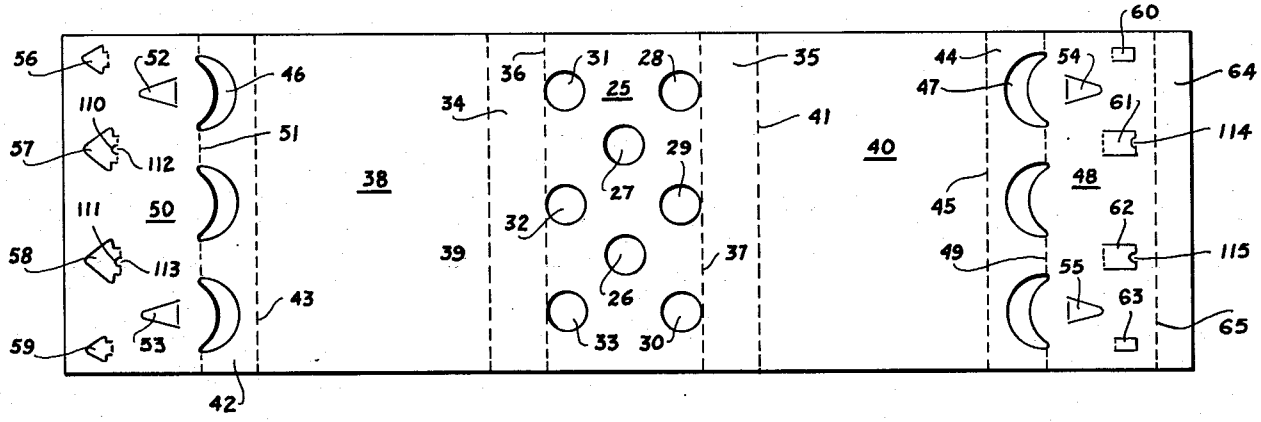
FIG. 2 is a plan view of a blank of the type to which the machine and method of this invention are particularly applicable.
Figure 3:
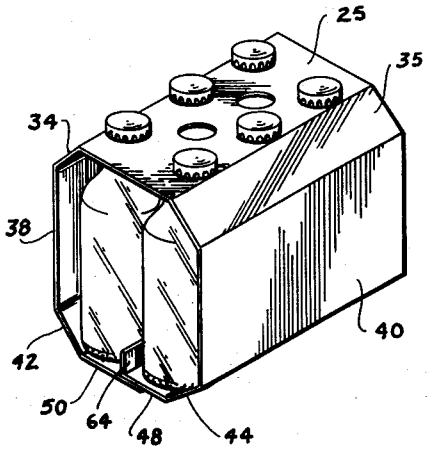
FIG. 3 is a perspective view of a completed package utilizing the blank depicted in FIG. 2 and showing six primary packages such as capped bottles packaged therein.

The blank depicted in FIG. 2 comprises a top panel 25 having finger gripping apertures 26 and 27 and a plurality of apertures 28, 29, 30, 31, 32 and 33 for receiving the necks of the packaged primary articles. It may be desirable to utilize a top panel 25 which overlies the crowns of the packaged bottles in which event the apertures 28–33 would not be used. Sloping panels 34 and 35 are foldably adjoined respectively to the side edges 36 and 37 of the top panel 25 and conform generally with the shoulders of the packaged bottles. Side wall 38 is foldably joined to sloping panel 34 along a fold line 39 while a similar side wall 40 is foldably joined to sloping panel 35 along a fold line 41. Another sloping panel 42 is foldably joined to the bottom edge of side wall 38 along fold line 43 and a similar sloping panel 44 is foldably joined to the bottom edge of side wall 40 along fold line 45. Formed in each of the sloping panels is a plurality of apertures 46 and 47 formed respectively in the sloping panels 42 and 44. These known apertures are for receiving the lower portions of the packaged items to aid in securing the bottles as a unitary group. The bottom of the wrapper is a composite wall structure comprising the lap panel 48 foldably joined to sloping panel 44 along a fold line 49 together with a similar lap panel 50 foldably joined to sloping panel 42 along a fold line 51. The wrapper is tightened in known manner by suitable machine elements which enter the tightening apertures 52 and 53 in panel 50 and by suitable opposed machine elements disposed in tightening apertures 54 and 55 formed in lap panel 48.

The wrapper is secured about the article group by locking tabs 56, 57, 58 and 59 formed in lap panel 50 which are driven by machine elements through the openings defined by retaining tabs 60, 61, 62 and 63 formed in lap panel 48. A medial separator panel designated by the numeral 64 is foldably joined to lap panel 48 along a fold line 65. When the package is complete, panel 64 occupies a medial position in the carrier as depicted for example in FIG. 3.

Once a particular article group such as that designated at B4 is appropriately assembled and moved toward the right by plungers 13 and with an associated wrapper 6 disposed atop the bottle group, the bottle group is then in condition for subsequent package forming operations. Thus, as is designated at B5, suitable folding structure which may take the form of a guide or plow 66 or which might take some other known form, engages a side panel such as 40 and initiates the downward folding thereof. Such folding is substantially complete when the bottle group arrives at the position depicted at B6. The subsequent folding operations are accomplished by mechanism not shown but which simply effects inward folding of lap panels such as are designated at 48 and 50 and suitable apparatus is employed to tighten the wrapper. Locking of the wrapper is effected by driving the locking tabs 56–59 through the respective apertures defined by retaining tabs 60–63, the medial panel 64 being vertically disposed upon completion of the formation of the package.

The endless conveyor 67 is mounted for clockwise rotation on rotatable elements 68, 69, 70 and 71 which are mounted on suitable shafts supported by bearings which in turn are mounted on the frame of the machine. Suitable plungers or flight bars are arranged on each side of the machine and are mounted on the conveyor 67. These plungers are designated generally in FIG. 1 by the numeral 72 and serve to move the packages toward the right in known manner.

Figure 4:
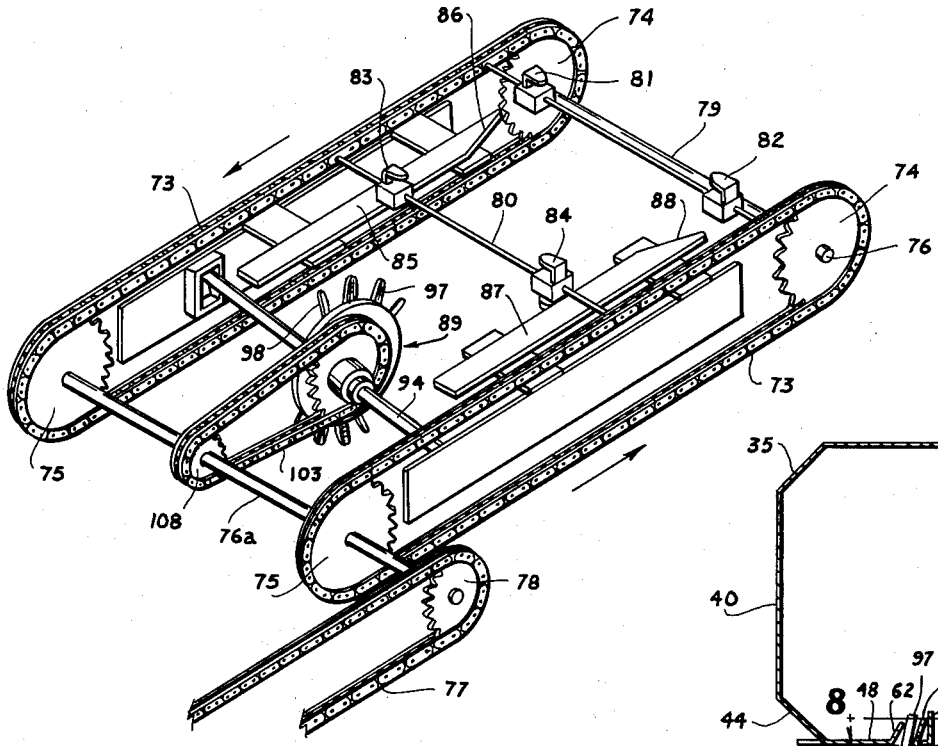
FIG. 4 is an enlarged perspective view of the opposite side of the right hand end of the machine shown in FIG. 1 and which embodies certain essential elements of the invention.

For the purpose of tightening the wrapper about its associated group of primary packages B and as shown in FIG. 4, a pair of endless chains 73 are mounted for rotation on sprockets 74 and 75 rotatable about shafts 76 and 76*a* which in turn are journaled in suitable bearings mounted on frame 1 of the machine. Sprockets 74 and 75 are driven by an endless chain 77 which cooperates with a sprocket 78 mounted on shaft 76*a*.

Tightening elements or rods such as 79 and 80 are secured at their ends to the chains 73. Slidably mounted on rods 79 and 80 are tightening elements 81, 82, 83 and 84. The elements 81 and 83 engage a fixed cam 85 having a beveled cam entry surface 86. Tightening elements 82 and 84 engage fixed cam 87 having beveled entry surface 88. Thus as the tightening elements 83 and 84, 81 and 82 move from right to left as shown in FIG. 4 they engage the cams 85 and 87 and are moved inwardly toward each other, it being apparent that carton tightening element 83 moves inwardly toward carton tightening element 84 which likewise moves inwardly toward its fellow tightening element 83. Tightening elements such as 81 and 83 enter tightening apertures such as 52 and 53 while machine tightening apertures such as 54 and 55.

In order to interlock the lap panels 48 and 50 by driving the locking tabs 56–59 inclusive into and through the apertures defined by retaining tabs 60–63 respectively, the mechanism shown best in FIGS. 5–8, inclusive, and generally designated by the numeral 89 is employed. The mechanism 89 comprises a pair of adjustably mounted shoe blocks 90 and 91 which are affixed by set screws 92 and 93 to the frame elements 1. These blocks 90 and 91 may be adjusted vertically and horizontally within limits. Secured to the shoe blocks 90 and 91 is an inclined shaft or support axis 94 which is secured by pins 95 and 96 to the blocks 90 and 91 respectively. Preferably the shaft 94 is inclined at an angle of about ten degrees from horizontal.

The rotary element constructed according to this invention may comprise one or more radially disposed locking fingers 97 and 98 mounted by bolts 99 and 100 respectively to rotatable hub 101 to which is affixed a sprocket 102 which cooperates with a flexible driving chain 103. Hub 101 is held in the desired position on fixed shaft 94 by a pair of collars 104 and 105 which are affixed to shaft 94 by any suitable means such as by set screws 106 and 107.

Operating movement which is synchronized with the other movable elements of the machine is imparted to chain 103 by a sprocket 108 which is affixed to and rotatable with the shaft 76*a*.

It will be understood that lap panel 50 ordinarily is disposed exterior to lap panel 48 and that the locking tabs such as 59 are disposed in general coincidence with their associated retaining tabs such as 63.

As is apparent from FIG. 2, locking tabs 56 and 59 are of conventional construction as are the retaining tabs 60 and 63.

Locking tabs 57 and 58 are formed according to the aforementioned U.S. application Ser. No. 759,057 and include securing apertures 110 and 111 which are struck from the locking tabs 57 and 58 respectively. Securing apertures 110 and 111 as is apparent from FIG. 2 are disposed at the base of their associated locking tabs and define reinforcing tabs 112 and 113 respectively. These reinforcing tabs are integral with the lap panel 50 as is apparent from FIG. 2. For cooperating with the securing apertures 110 and 111, the securing tabs 114 and 115 are in effect struck from the free ends of retaining tabs 61 and 62 respectively and thus constitute projections which extend inwardly from an edge of the locking apertures defined by retaining tabs 61 and 62 respectively all as disclosed and claimed in the aforementioned application Ser. No. 759,057.

While the locking tabs 57 and 58 and their associated retaining tabs 61 and 62 are specially configured and the locking tabs 56 and 59 and their associated retaining tabs 60 and 63 are conventional, it will be understood that all of the locking tabs and all of the retaining tabs could be constructed according to U.S. application Ser. No. 759,057.

Figure 6:
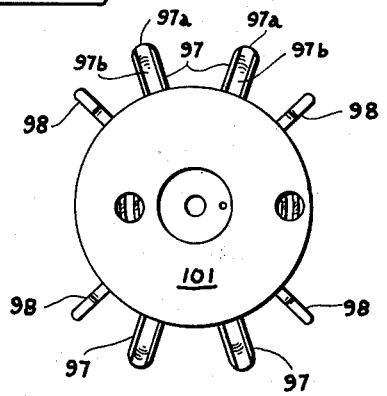
Figure 7:
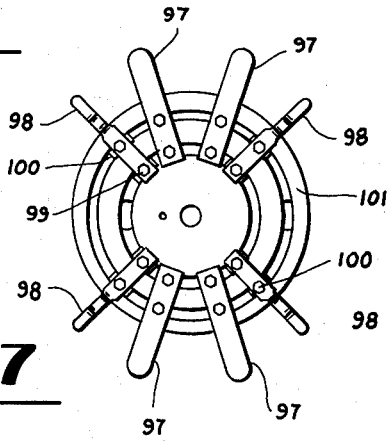
Figure 8:
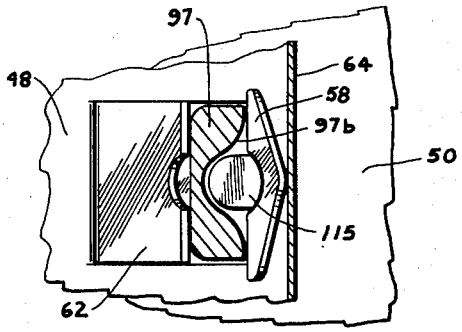
FIG. 8 is a view taken on line 8—8 in FIG. 5.

Locking fingers such as are indicated by the numeral 98 in FIGS. 6 and 7 are constructed with end portions which are relatively small and which tend simply to slide through the securing apertures such as 110 and 111 without effecting a locking operation of the locking tabs 57 and 58 and hence are unsuitable. This action also tends to cause damage to the securing tabs 114 and 115 which are disposed in coincidence with the reinforcing tabs 112 and 113 respectively as is obvious.

Figure 5:
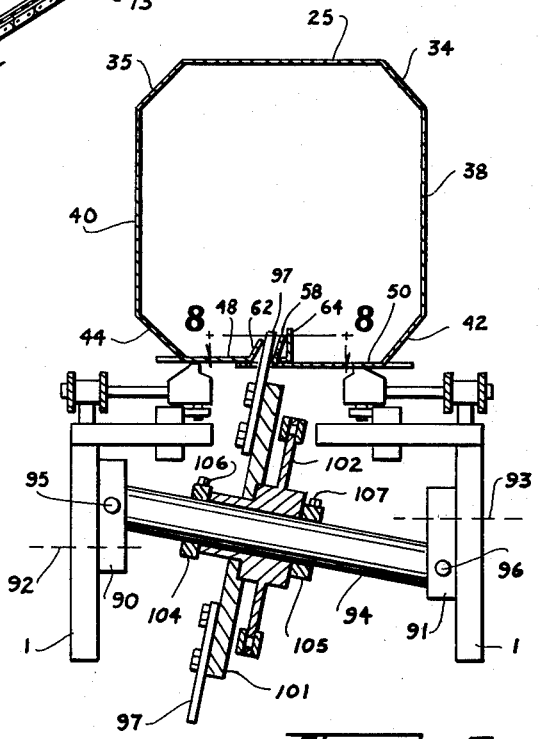
FIG. 5 is a cross sectional view taken along the line 5—5 in FIG. 1.

In accordance with this invention, the locking fingers 97 are specially constructed so as to effect efficient locking of the special locking tabs 57 and 58. More specifically and as is best shown in FIGS. 6 and 7 the end portions 97*a* of the locking fingers 97 are substantially larger in cross sectional area than are the areas of the securing apertures 110 and 111. By means of the larger fingers 97, inadvertent and undesired insertion of the locking fingers through the securing apertures 110 and 111 is precluded. In addition, the locking fingers 97 are arranged with a groove 97*b* formed in a side edge thereof. AS is apparent in FIG. 8, the groove 97*b* receives the reinforcing tab 112 and its associated securing tab 114 disposed immediately therebelow and in coincidence therewith. Furthermore the arcuate end edge such as 97*a* is defined by a radius which is disposed in the plane in which the locking fingers 97 are rotatable. This configuration facilitates smooth and efficient entry of the locking fingers into the locking apertures particularly since the locking and retaining tabs are disposed in transverse relation to the path of movement of the wrappers and their associated articles during the packaging operation. Also the axis of the shaft 94 as is apparent from FIG. 5 is transverse to the path of movement of the blanks and of their associated primary packages during the packaging operation.

The embodiments of the invention in which an exclusive property or privilege is claimed are defined as follows:

1. A mechanism for interlocking a pair of panels in face contacting relation, one of said panels having a locking tab formed therein and adjoined to said one panel at its base and such locking tab having a securing aperture formed therein at the base thereof, the other of said panels having a retaining tab formed therein and defining a locking aperture from an edge of which a securing tab projects, said panels being arranged so that said locking tab and said retaining tab are aligned and with said securing tab initially disposed in substantial coincidence with said securing aperture, said mechanism comprising a movable locking finger having an end portion for engaging said locking tab and operable to drive and locking tab through said locking aperture and simultaneously to cause said securing aperture to receive said securing tab, said locking finger being substantially larger in cross sectional area than said securing aperture and having a clearance groove formed along a side thereof for receiving said securing tab during locking movement of said locking finger.

2. A mechanism according to claim 1 wherein said locking finger comprises a radially arranged component of a rotatable locking element.

3. A mechanism according to claim 2 wherein said mechanism includes means for moving said panels along a predetermined path and wherein said locking and said retaining tabs and the axis of rotation of said rotatable locking element are transverse to said predetermined path.

4. A mechanism according to claim 3 wherein said axis is angularly disposed to said panel and wherein said locking finger swings said locking tab through an angle in excess of ninety degrees and wherein the side of said locking finger in which said clearance groove is formed engages said locking tab.

5. A mechanism according to claim 2 wherein said end portion of said locking finger is of arcuate configuration and wherein the radius of curvature thereof is disposed within the plane in which said locking finger is rotatable.

6. A mechanism according to claim 1 wherein said securing aperture defines a reinforcing tab in substantial coincidence with said securing tab and wherein said clearance groove receives said reinforcing tab.

7. A method of interlocking a pair of panels one panel having a shouldered locking tab formed therein and having a securing aperture at the base of said locking tab, the other panel having a locking aperture formed therein from an edge of which a securing tab projects, the method comprising initially arranging the panels in flat face contacting relation and with said locking tab in coincidence with said locking aperture and with said securing tab in coincidence with said securing aperture, engaging and driving said locking tab through said locking aperture and into a position of angular relation to said one panel and thereby substantially simultaneously causing said securing aperture to receive said securing tab.

8. A method according to claim 7 wherein said locking aperture is defined by a retaining tab from the free end of which said securing tab is struck and wherein locking movement of said locking tab is accompanied by swinging movement of said retaining tab into an angular bracing position relative to said locking tab and with its free end in abutting engagement with said locking tab.

* * * * *